US006162379A

United States Patent [19]

Shin et al.

[11] Patent Number: 6,162,379

[45] Date of Patent: Dec. 19, 2000

[54] FLASH SPINNING PROCESS AND FLASH SPINNING SOLUTION

[75] Inventors: Hyunkook Shin, Wilmington; Roger Keith Siemionko, Hockessin, both of Del.

[73] Assignee: E. I. du Pont de Nemours and Company, Wilmington, Del.

[21] Appl. No.: 09/300,953

[22] Filed: Apr. 28, 1999

Related U.S. Application Data

[62] Division of application No. 09/009,292, Jan. 20, 1998, Pat. No. 5,985,196.

[51] Int. Cl.[7] ..... B29C 67/20; D01D 5/11

[52] U.S. Cl. ..... 264/41; 264/53; 264/205; 264/211

[58] Field of Search ..... 264/13, 41, 49, 264/51, 53, 205, 211, 211.14

[56] References Cited

U.S. PATENT DOCUMENTS

| | | | |
|---|---|---|---|
| 3,851,023 | 11/1974 | Brethauer et al. | 264/441 |
| 5,023,025 | 6/1991 | Shin | 264/13 |
| 5,032,326 | 7/1991 | Shin | 264/13 |
| 5,147,586 | 9/1992 | Shin et al. | 264/13 |
| 5,286,422 | 2/1994 | Kato et al. | 264/13 |
| 5,672,307 | 9/1997 | Shin et al. | 264/205 |
| 5,723,084 | 3/1998 | Shin | 264/205 |

FOREIGN PATENT DOCUMENTS

WO97/25460 7/1997 WIPO .

*Primary Examiner*—Leo B. Tentoni

[57] ABSTRACT

A process for producing plexifilamentary products by spinning from a spin fluid of a polyolefin dissolved in a primary spin agent selected from the group consisting of 1,1,2-trichloro-2,2-difluoroethane and isomers thereof; 1,1,3-trichloro-2,2,3,3-tetrafluoropropane and isomers thereof; 1,2-dichloro-3,3,3-trifluoropropane and isomers thereof; and 1,2-dichloro-1-fluoroethylene; and a co-spin agent; and also a spin fluid of a polyolefin dissolved in a primary spin agent selected from the group consisting of 1,1,2-trichloro-2,2-difluoroethane and isomers thereof; 1,1,3-trichloro-2,2,3,3-tetrafluoropropene and isomers thereof; 1,2-dichloro-3,3,30-trifluoropropane and isomers thereof; and 1,2-dichloro-1-fluoroethylene; and a co-spin agent.

8 Claims, 16 Drawing Sheets

12% PE in HCFC-122/HFOC E-1

12% PE in HCFC-122/HFC-134a

12% PE in HCFC-122/HCFC-43-10mee

12% PE in HCFC-122/HCFC-123

9% PP in HCFC-122/HCFC-123

8% PP in HCFC-122/PF5052

12% PE in HCFC-224ca

12% PE in HCFC-243db

12% PE in 1,2-Dichloro-1-fluoroethylene

20% TEFZEL in HCFC-123/HCFC-122

20% HALAR in HCFC-122/HCFC-123

FLASH SPINNING PROCESS AND FLASH SPINNING SOLUTION

This is a division of Application Ser. No. 09/009,292 filed Jan. 20, 1998, now U.S. Pat. No. 5,985,196.

FIELD OF THE INVENTION

This invention relates to flash-spinning of polymeric, plexifilamentary, film-fibril strands. More particularly, this invention relates to a spin fluid that may be used in existing commercial equipment with minimum changes in the equipment, and to a spinning process using existing commercial equipment in which the spinning process utilizes compounds having very low ozone depletion potential, and in which the spinning process is carried out utilizing compounds that are either non-flammable or of very low flammability.

BACKGROUND OF THE INVENTION

Commercial spunbonded products made from polyethylene plexifilamentary film-fibril strands have been produced by flash-spinning from trichlorofluoromethane; however, trichlorofluoromethane is an atmospheric ozone depletion chemical, and therefore, alternatives have been under investigation. Shin U.S. Pat. No. 5,032,326 discloses one alternative spin fluid, namely, methylene chloride and a co-spin agent halocarbon having a boiling point between −50° C. and 0° C. As pointed out in Kato et al. U.S. Pat. No. 5,286,422, the Shin methylene chloride-based process is not entirely satisfactory, and the '422 patent discloses an alternative, specifically, a spin fluid of bromochloromethane or 1,2-dichloroethylene and a co-spin agent of, e.g., carbon dioxide, dodecafluoropentane, etc.

Published Japanese Application JO5263310-A (published Oct. 12, 1993) discloses that three-dimensional fiber favorable for manufacturing flash-spun non-woven sheet may be made from polymer dissolved in mixtures of spin agents where the major component of the spin agent mixture is selected from the group consisting of methylene chloride, dichloroethylene, and bromochloromethane, and the minor component of the spin agent mixture is selected from the group consisting of dodecafluoropentane, decafluoropentane, and tetradecafluorohexane. However, it is known, for example, that methylene chloride is an animal carcinogen and dichloroethylene is somewhat flammable.

U.S. Pat. No. 5,023,025 to Shin discloses a process for flash-spinning plexifilamentary film-fibril strands of fiber-forming polyolefin from a group of halocarbon liquids that present a greatly reduced ozone depletion hazard. The patent discloses 1,1-dichloro-2,2,2-triflouroethane (HCFC-123) as a preferred halocarbon (halogenated hydrocarbon). HCFC-123 is a very good spin agent for polypropylene but not for polyethylene, and in the latter case a very high spinning pressure would be required. As such, for use with polyethylene, a co-spin agent has to be employed that is capable of dissolving polyethylene at relatively low pressures (i.e., a strong solvent). The '025 patent also discloses dichlorodifluoroethane (HCFC-132b and its isomers) and dichlorofluoroethane (HCFC-141b and its isomers), all of which have significant disadvantages. For example, HCFC-132b is a good spin agent, but toxic. HCFC-141b is also a good spin agent, but somewhat flammable, and moreover exhibits a relatively high ozone depletion potential.

SUMMARY OF THE INVENTION:

The present invention is a process for the preparation of plexifilamentary film-fibril strands of synthetic fiber-forming polyolefin which comprises flash-spinning at a pressure that is greater than the autogenous pressure of the spin fluid into a region of lower pressure, a spin fluid comprising (a) 5 to 30 wgt. % synthetic fiber-forming polyolefin, and (b) a primary spin agent selected from the group consisting of 1,1,2-trichloro-2,2-difluoroethane (HCFC-122) and isomers thereof; 1,1,3-trichloro-2,2,3,3-tetrafluoropropane (HCFC-224ca) and isomers thereof; 1,2-dichloro-3,3,3-trifluoropropane (HCFC-243db) and isomers thereof; and 1,2-dichloro-1-fluoroethylene (HCFC-1121). A co-spin agent can be present in the spin fluid in an amount sufficient to raise the cloud point pressure of the spin fluid by at least 50 pounds per square inch (psi) (345 kPa).

This invention is also a spin fluid comprising (a) 5 to 30 wgt. % synthetic fiber-forming polyolefin, and (b) a primary spin agent selected from the group consisting of HCFC-122 and isomers thereof, HCFC-224ca and isomers thereof, HCFC-243db and isomers thereof, and HCFC-1121. A co-spin agent can be present in the spin fluid in an amount sufficient to raise the cloud point pressure of the spin fluid by at least 50 psi (345 kPa).

This invention is also directed to a process for the preparation of microcellular foam fibers from synthetic fiber-forming polyolefin which comprises flash-spinning at a pressure that is greater than the autogenous pressure of the spin fluid into a region of lower pressure, a spin fluid comprising (a) at least 40 wgt. % synthetic fiber-forming polyolefin, and (b) a primary spin agent selected from the group consisting of HCFC-122 and isomers thereof.

BRIEF DESCRIPTION OF THE DRAWINGS

The accompanying drawings, together with the description, serve to explain the principles of the invention.

DETAILED DESCRIPTION OF THE INVENTION

The term "synthetic fiber-forming polyolefin" is intended to encompass the classes of polymers typically disclosed in the flash-spinning art, e.g., polyethylene, polypropylene, and polymethylpentere. For the subject invention, TEFZEL®, a fluoropolymer obtained from DuPont, which is a copolymer of ethylene and tetrafluoroethylene can be used. Also, HALAR®, fluoropolymer resin obtained from Ausimont, which is a copolymer of ethylene and chlorotrifluoroethylene can be used in the subject invention.

The term "polyethylene" as used herein is intended to encompass not only homopolymers of ethylene, but also copolymers wherein at least 85% of the recurring units are ethylene units. One preferred polyethylene is linear high density polyethylene which has an upper limit of melting range of about 130 to 140° C., a density in the range of 0.94 to 0.98 gram per cubic centimeter, and a melt index (as defined by ASTM D-1238-57T Condition E) of between 0.1 and 100, preferably less than 4.

The term "polypropylene" is intended to embrace not only homopolymers of propylene but also copolymers where at least 85% of the recurring units are propylene units.

A preferred synthetic fiber-forming polyolefin is linear polyethylene, and an alternative is isotactic polypropylene. Also, the synthetic fiber-forming polyolefin can be a mixture of polyethylene and polypropylene as disclosed in International Publication WO 97/25460.

The preferred process employs a spin fluid in which the synthetic fiber-forming polyolefin concentration is in the range of 8 to 18 wgt. % of the spin fluid. The term spin fluid as used herein means the solution comprising the fiber-forming polyolefin, the primary spin agent and any co-spin agent that is present. Unless noted otherwise the term wgt. % as used herein refers to the percentage by weight based on the total weight of the spin fluid.

The term "cloud-point pressure" as used herein, means the pressure at which a single phase liquid solution starts to phase separate into a polymer-rich/spin liquid-rich two-phase liquid/liquid dispersion. However, at temperatures above the critical point, there cannot be any liquid phase present and therefore a single phase supercritical solution phase separates into a polymer-rich/spin fluid-rich, two-phase gaseous dispersion.

Figure 1:
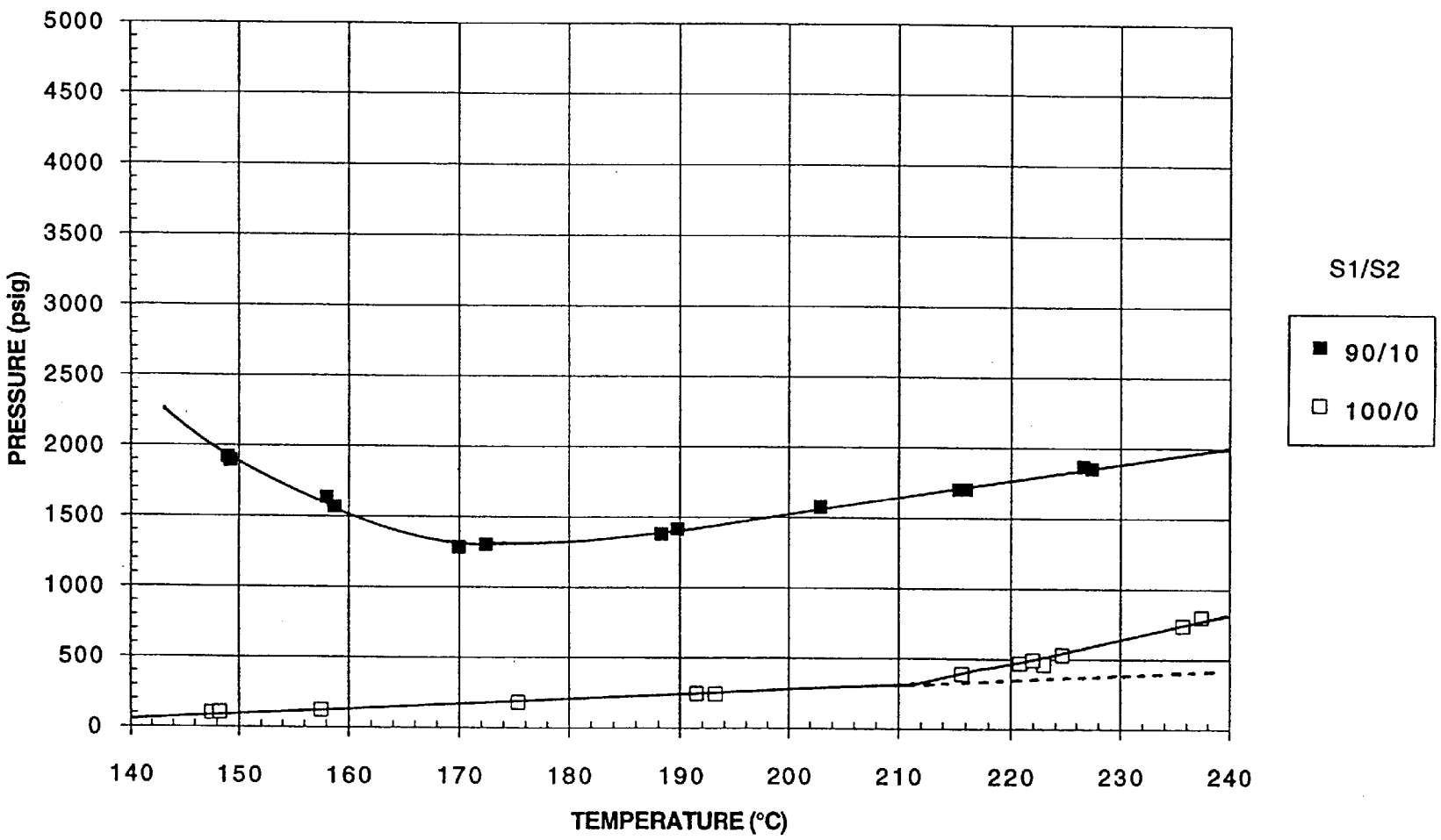
FIG. 1 is a plot of the cloud point data for a solution comprised of 12% of polyethylene in a solvent comprised of HCFC-122 and 10% HFOC E-1.
Figure 2:
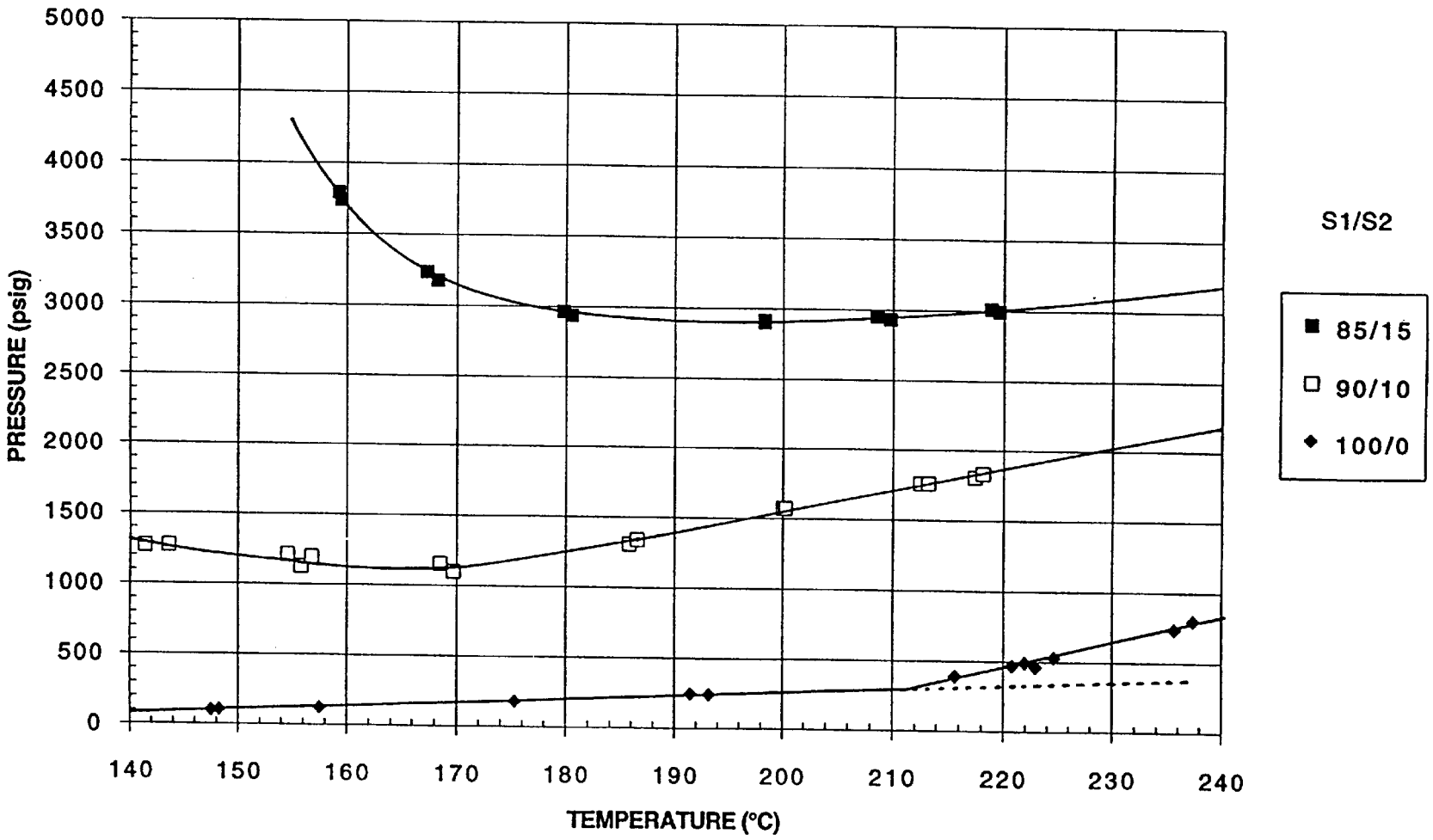
FIG. 2 is a plot of the cloud point data for a solution comprised of 12% of polyethylene in a solvent comprised of HCFC-122 and HFC-134a at different ratios.
Figure 3:
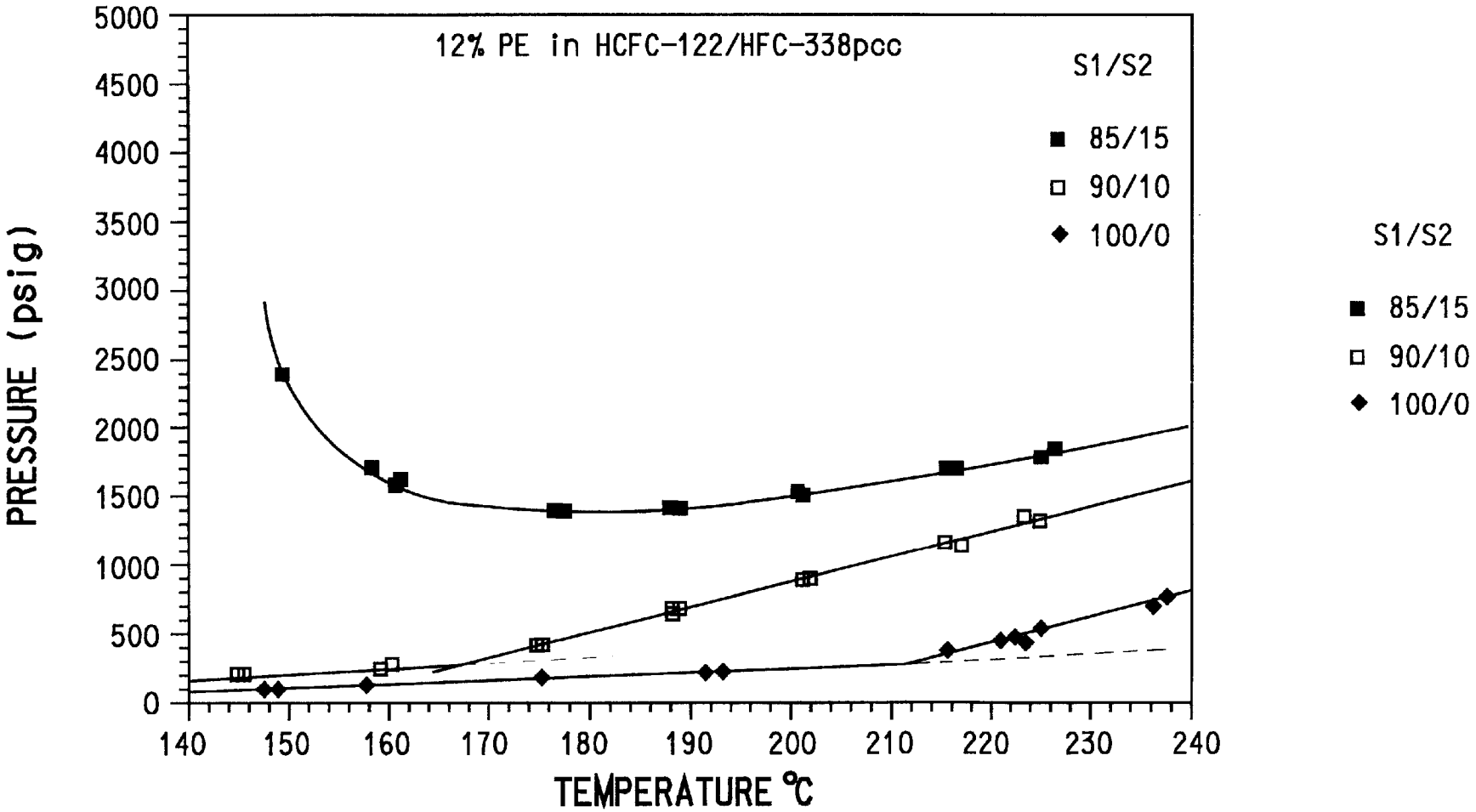
FIG. 3 is a plot of the cloud point data for a solution comprised of 12% of polyethylene in a solvent comprised of HCFC-122 and HFC-338pcc at different ratios.
Figure 4:
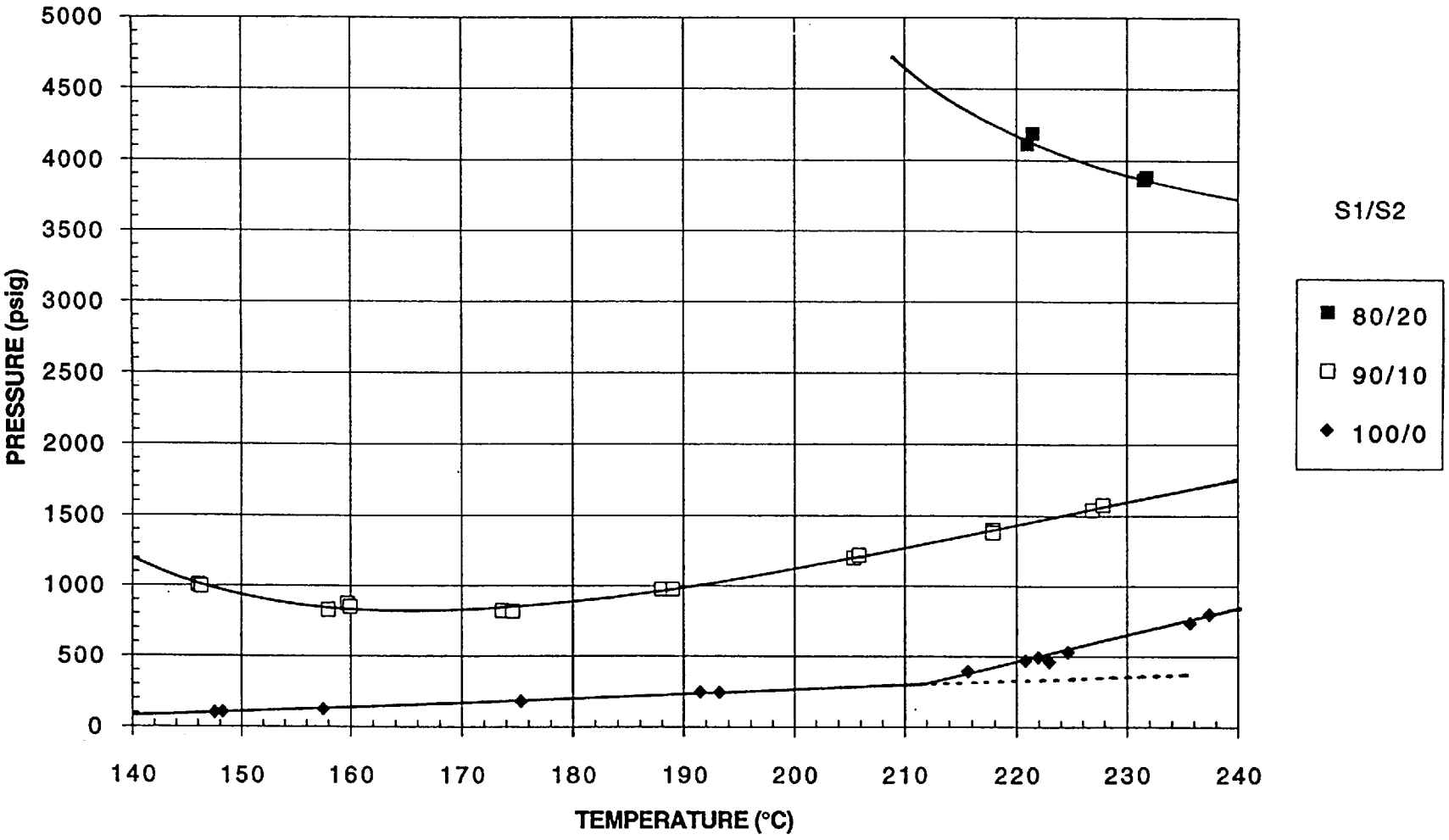
FIG. 4 is a plot of the cloud point data for a solution comprised of 12% of polyethylene in a solvent comprised of HCFC-122 and HFFC-4310mee at different ratios.
Figure 5:
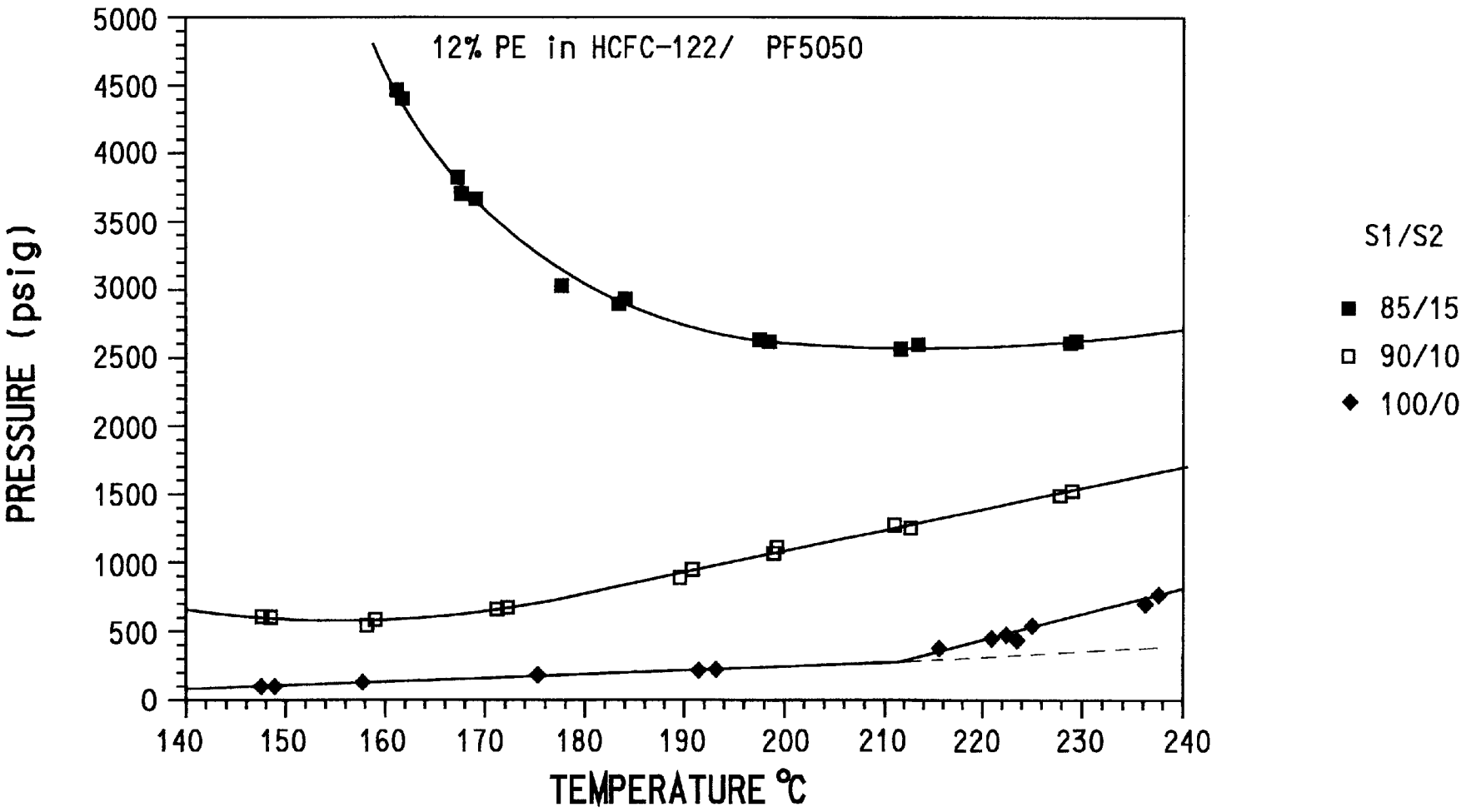
FIG. 5 is a plot of the cloud point data for a solution comprised of 12% of polyethylene in a solvent comprised of HCFC-122 and PF-5050 at different ratios.
Figure 6:
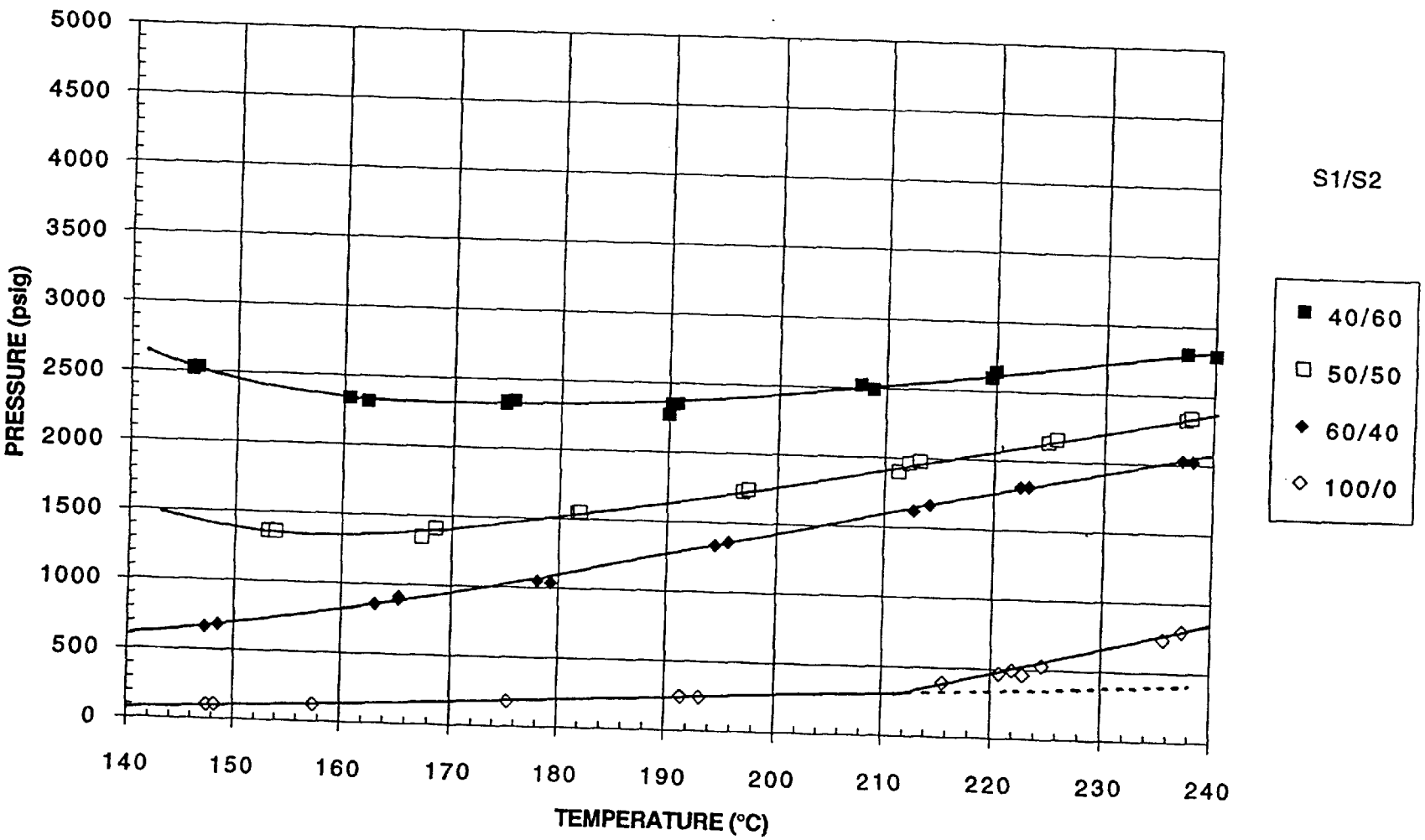
FIG. 6 is a plot of the cloud point data for a solution comprised of 12% of polyethylene in a solvent comprised of HCFC-122 and HCFC-123 at different ratios.
Figure 7:
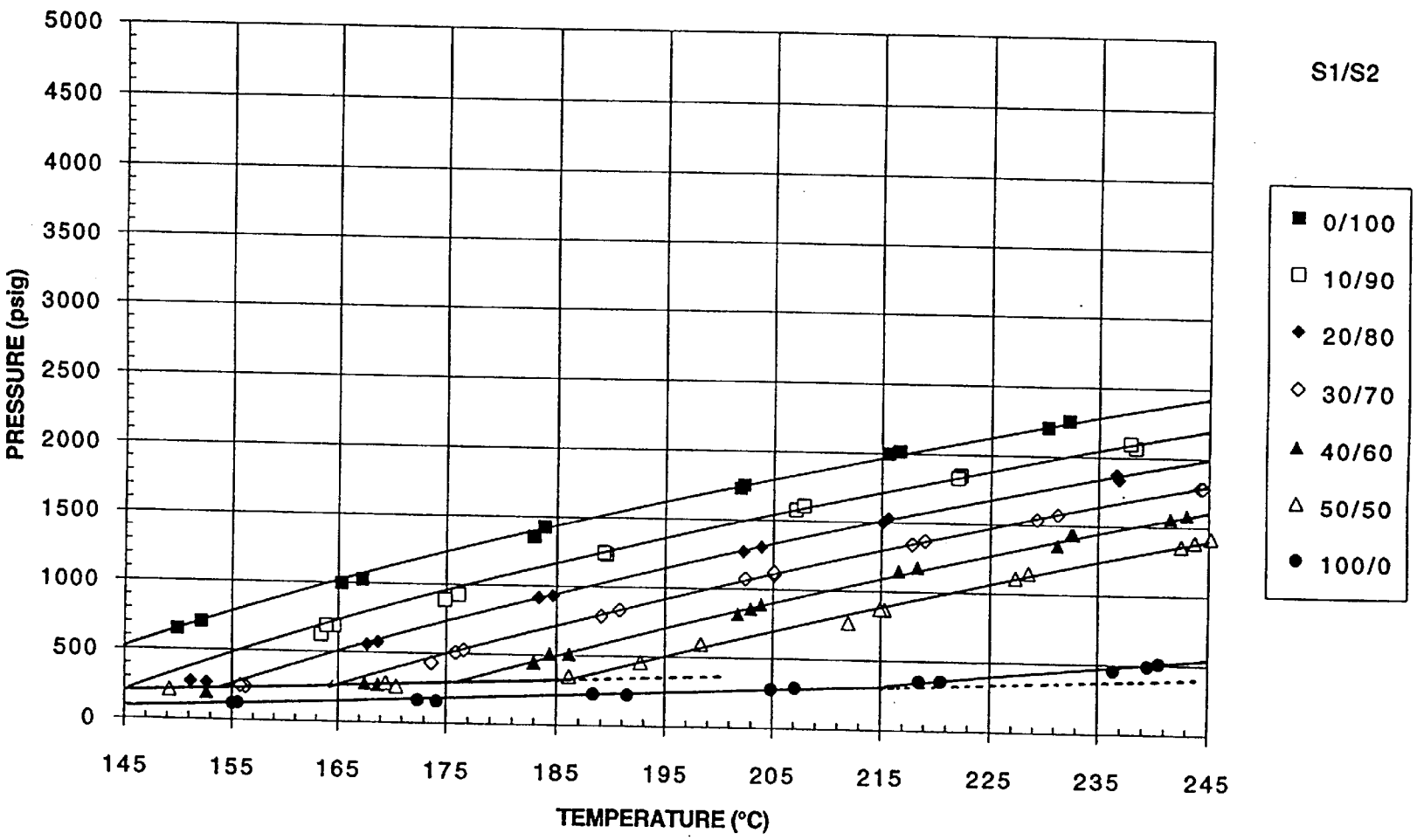
FIG. 7 is a plot of the cloud point data for a solution comprised of 9% of polypropylene in a solvent comprised of HCFC-122 and HCFC-123 at different ratios.
Figure 8:
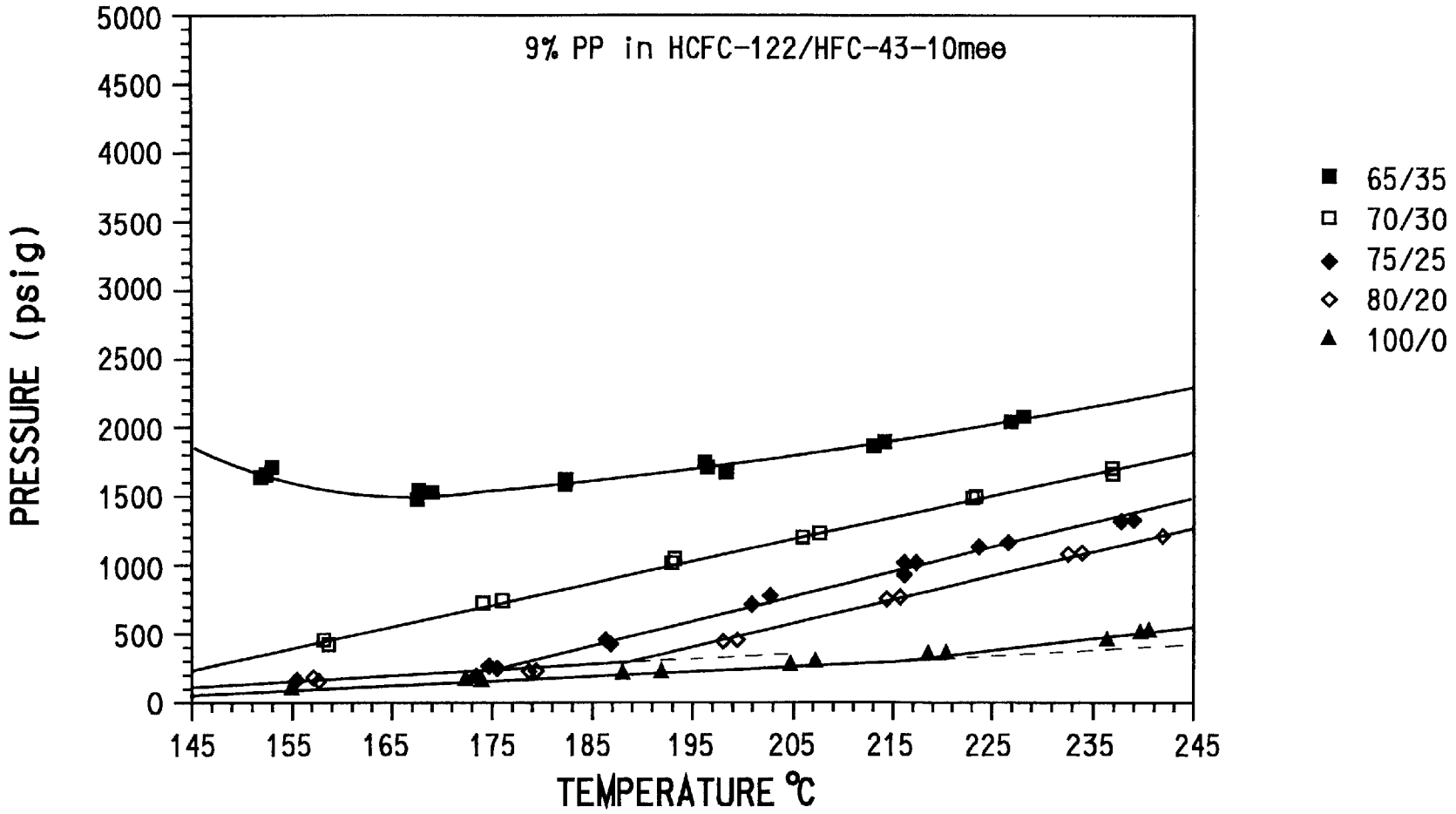
FIG. 8 is a plot of the cloud point data for a solution comprised of 9% of polypropylene in a solvent comprised of HCFC-122 and HFC-4310mee at different ratios.
Figure 9:
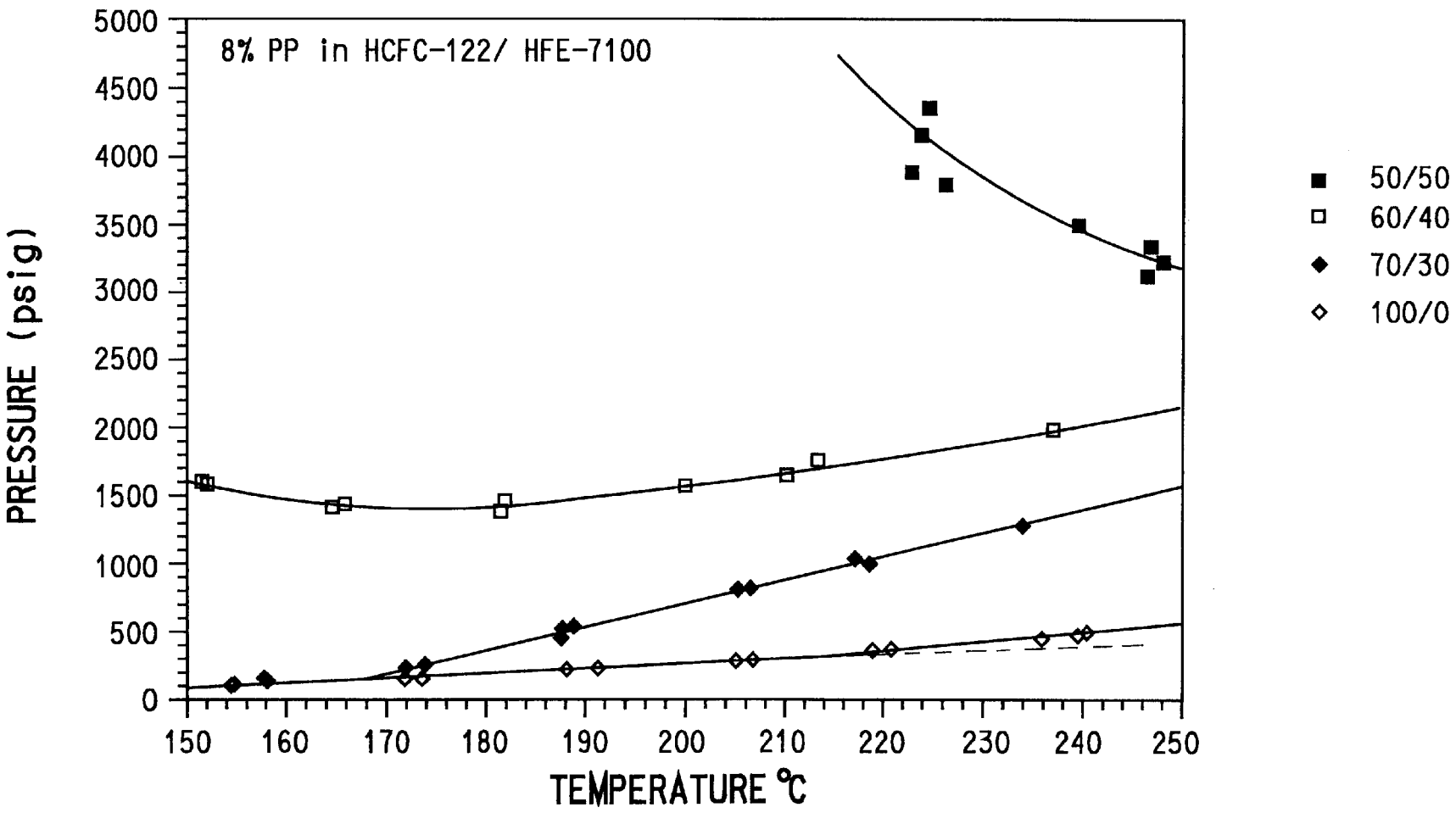
FIG. 9 is a plot of the cloud point data for a solution comprised of 8% of polypropylene in a solvent comprised of HCFC-122 and HFE-7100 at different ratios.
Figure 10:
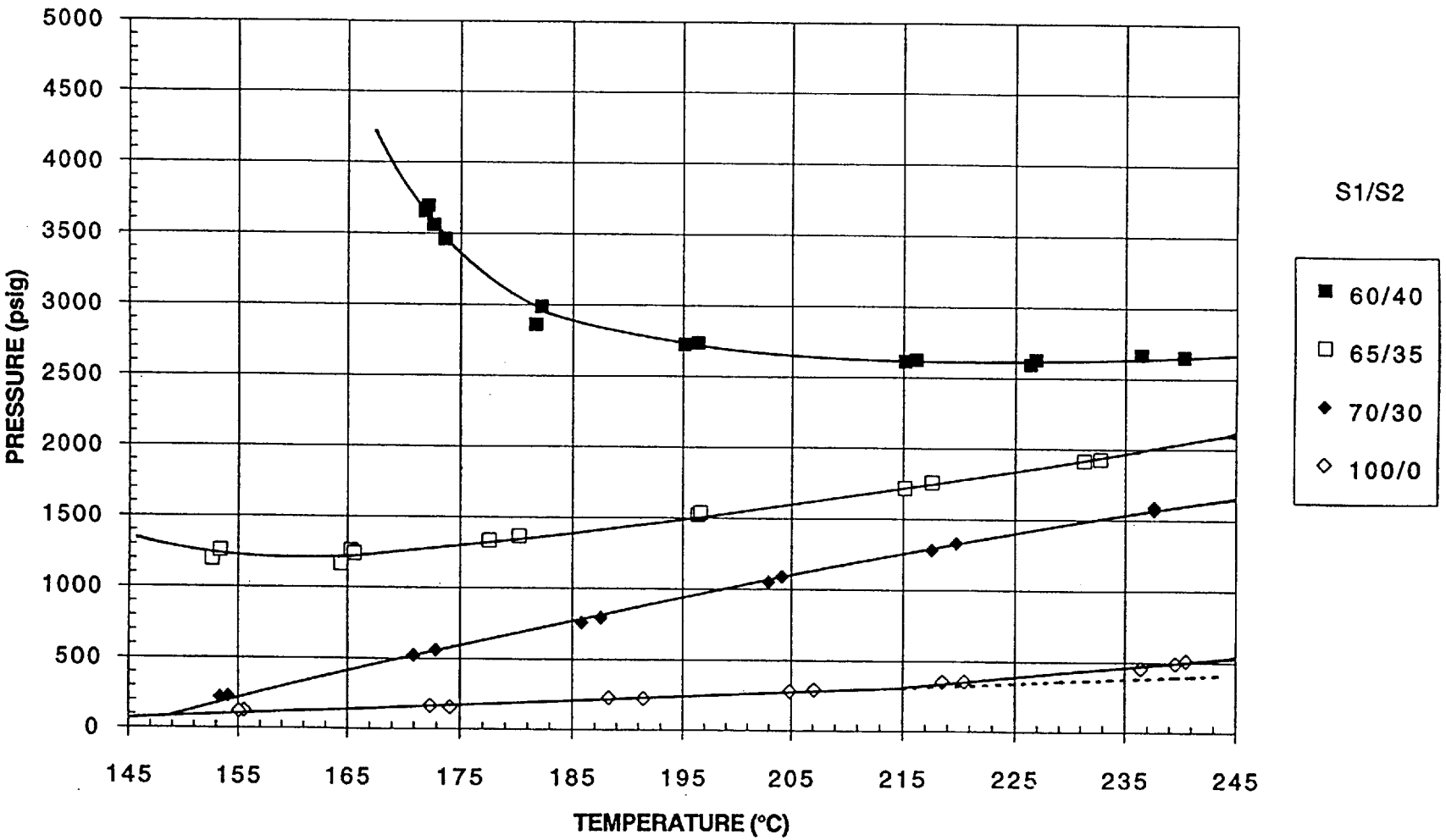
FIG. 10 is a plot of the cloud point data for a solution comprised of 8% of polypropylene in a solvent comprised of HCFC-122 and PF5052 at different ratios.
Figure 11:
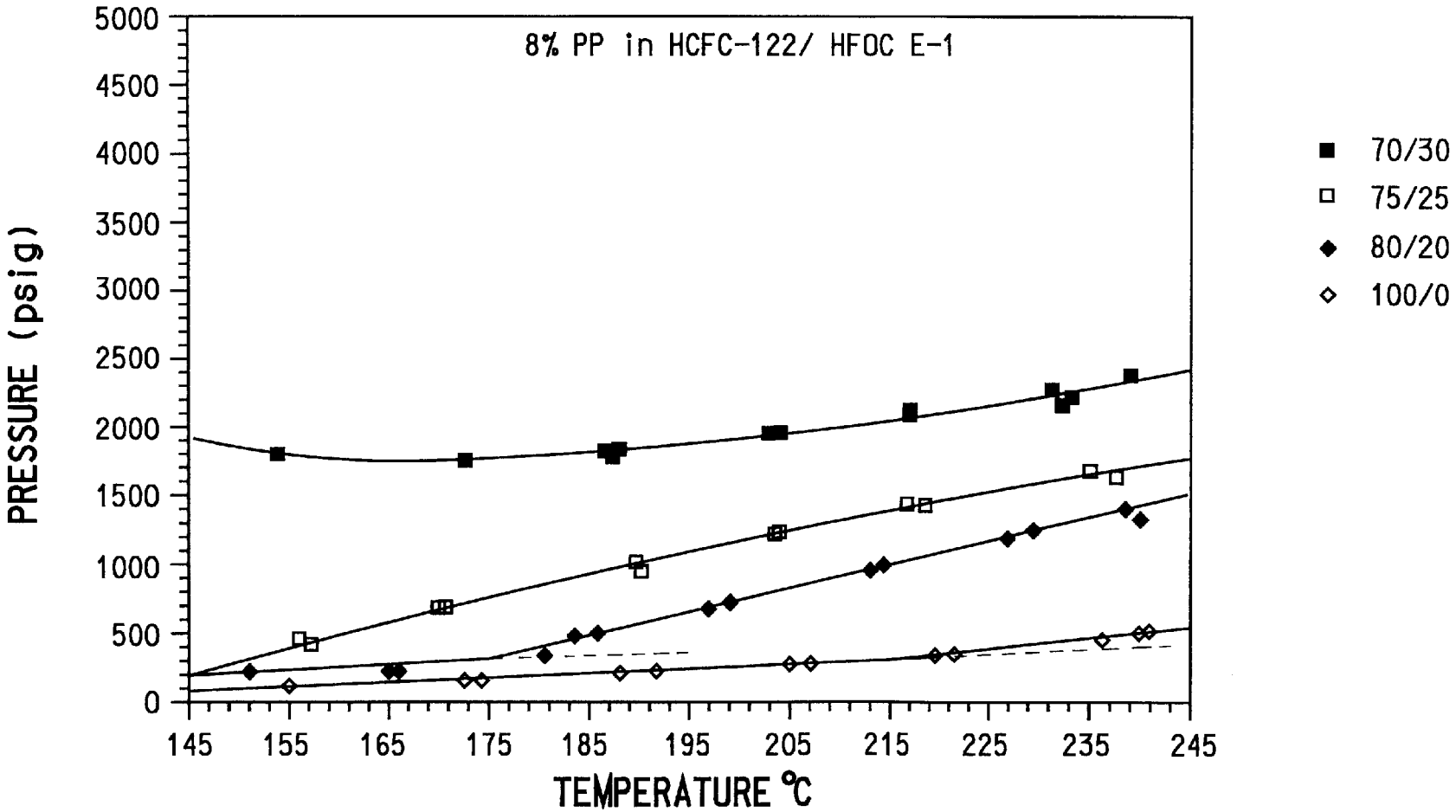
FIG. 11 is a plot of the cloud point data for a solution comprised of 8% of polypropylene in a solvent comprised of HCFC-122 and HFOC E-1 at different ratios.

To raise the cloud-point pressure the co-spin agent in the spin fluid must be a "non-solvent" for the polymer, or at least a poorer solvent than the primary spin agent. In other words, the solvent power of the co-spin agent of the spin fluid used must be such that if the polymer to be flash-spun were to be dissolved in the co-spin agent alone, typically, the polymer would not dissolve in the co-spin agent, or the resultant solution would have a cloud-point pressure greater than about 7000 psig (pounds per square inch gage) which is about 48,360 kilopascals (kPa). Note that 1 psig is about 108 kPa and 1 psi is 6.90 kPa. The interaction between primary spin agents and co-spin agents can be demonstrated by reference to FIGS. 6 and 7. It is noted that the general term "spin agent" may refer to a primary spin agent when used alone or either the primary spin agent combined with a co-spin agent. FIG. 6 shows that HCFC-122 is a very good solvent for polyethylene and 1,1-dichloro-2,2,2-trifluoroethane (HCFC-123) is not as good a solvent so it raises the cloud point pressure by some amount. FIG. 7 shows that for polypropylene HCFC-123 does not raise that cloud point pressure as much as in FIG. 6 because HCFC-123 is a better solvent for polypropylene than it is for polyethylene, but still a "poorer" solvent for both than is HCFC-122.

HCFC-122 and isomers thereof are such good spin agents for the polyolefins that are commercially employed in the formation of flash spun products, i.e., polyethylene and polypropylene, that there is no cloud point until the bubble point is reached or the cloud-point pressure is so close to the bubble point that it is not possible to operate efficiently. By employing one of the co-spin agents listed below, the solvent power of the mixture is lowered sufficiently so that flash spinning to obtain the desired plexifilamentary product is readily accomplished.

Figure 12:
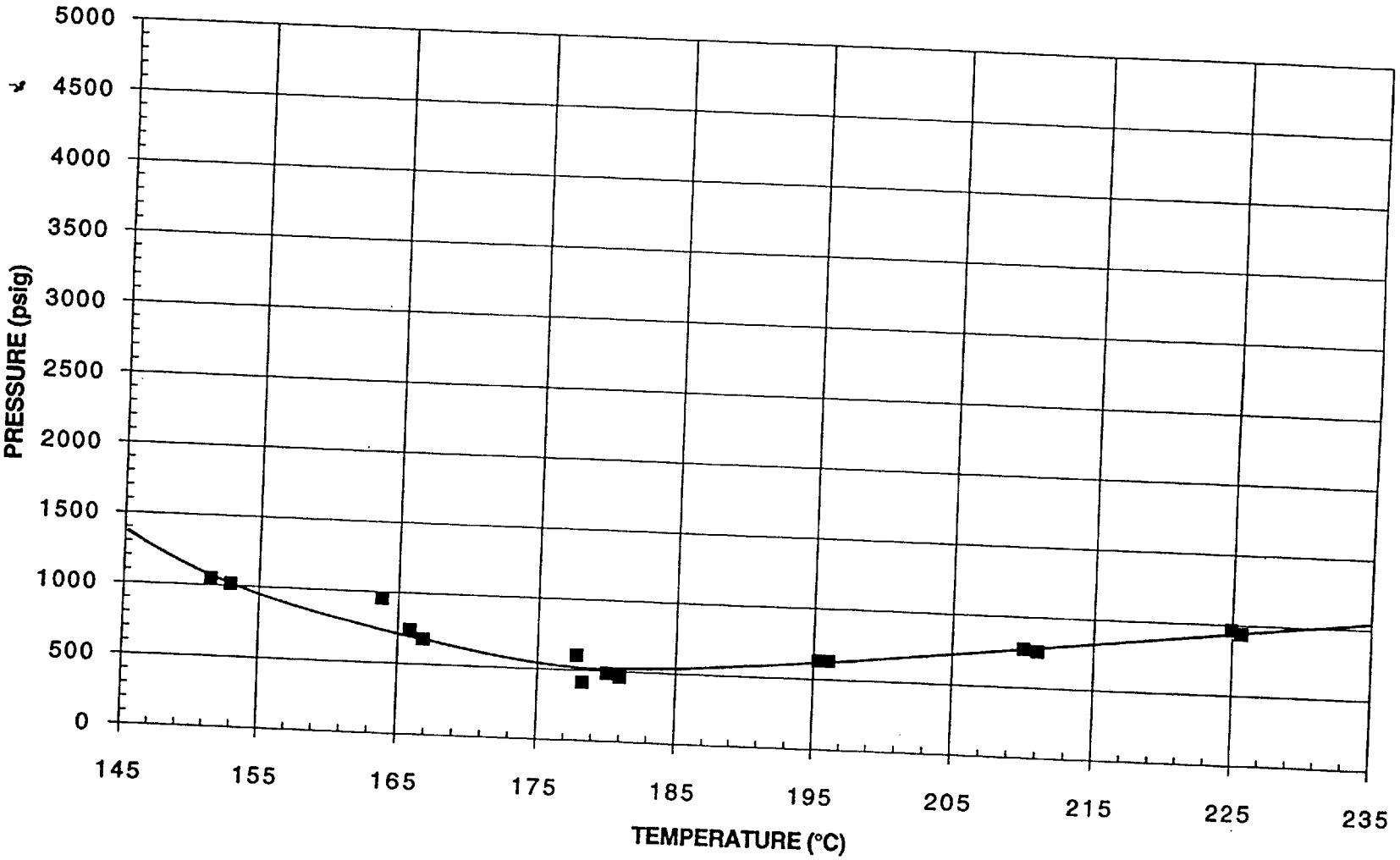
FIG. 12 is a plot of the cloud point data for a solution comprised of 12% of polyethylene in a solvent comprised of 100% HCFC-224ca.
Figure 13:
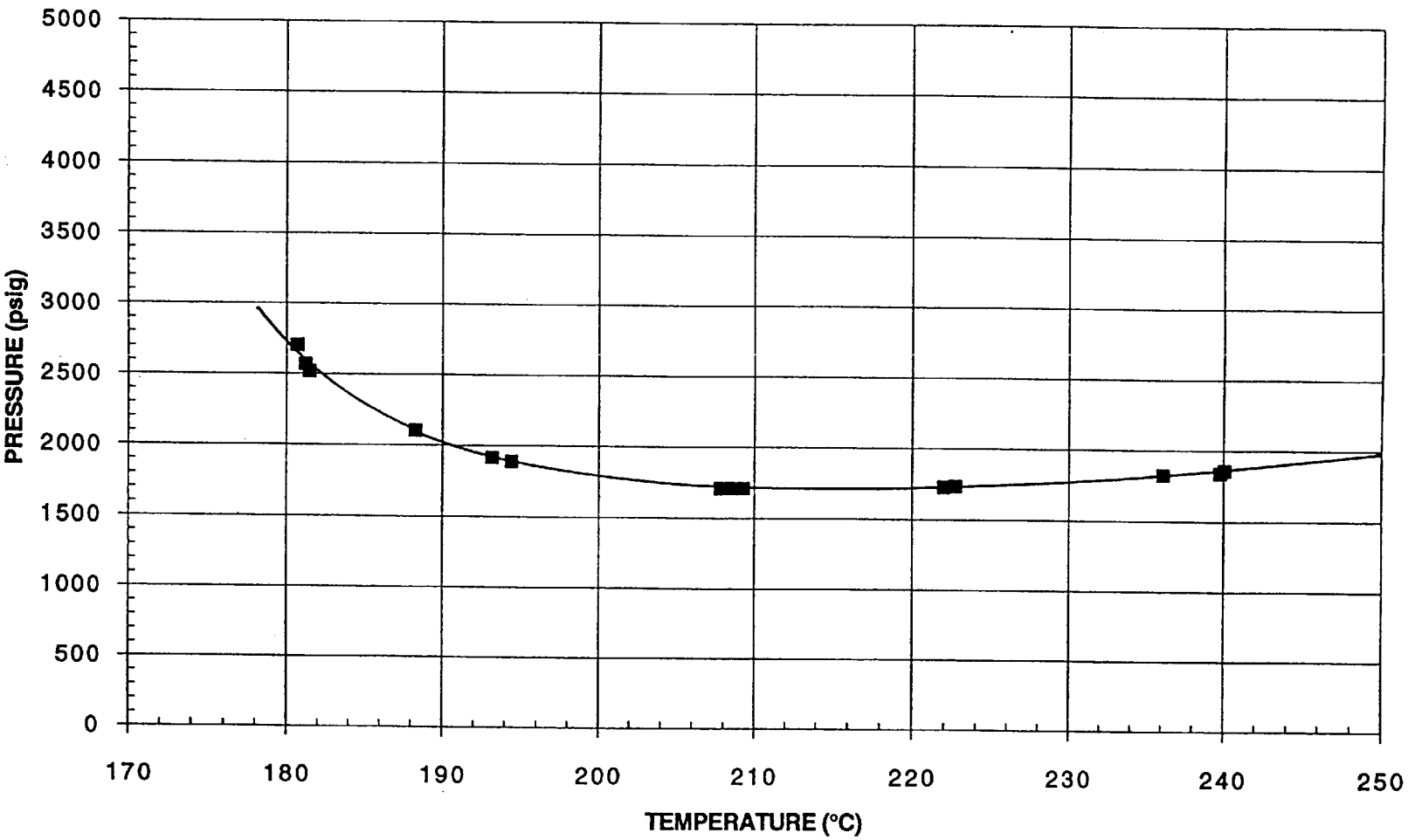
FIG. 13 is a plot of the cloud point data for a solution comprised of 12% of polyethylene in a solvent comprised of 100% HCFC-243db.
Figure 14:
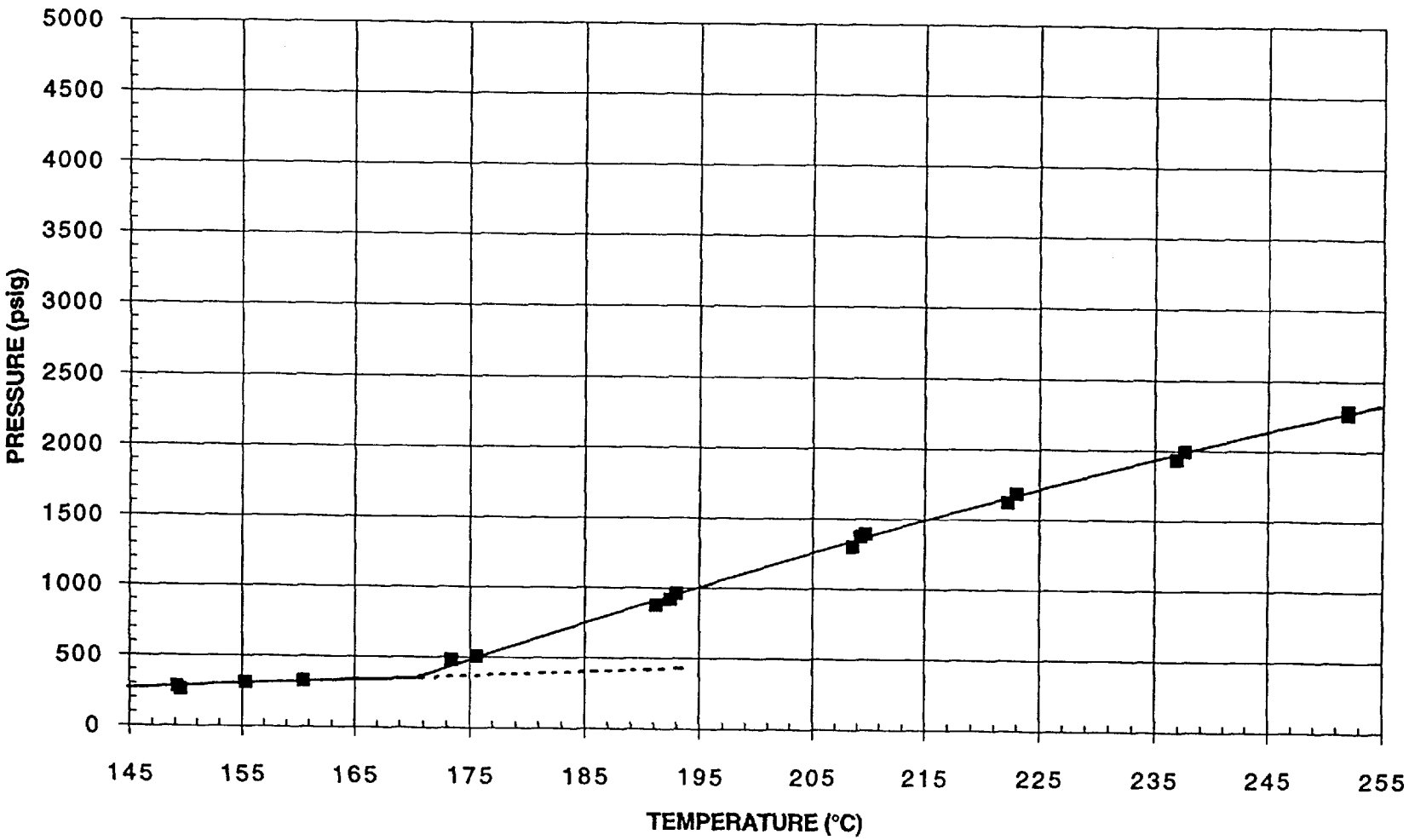
FIG. 14 is a plot of the cloud point data for a solution comprised of 12% of polyethylene in a solvent comprised of 1,2-dichloro-1-fluoroethylene.
Figure 15:
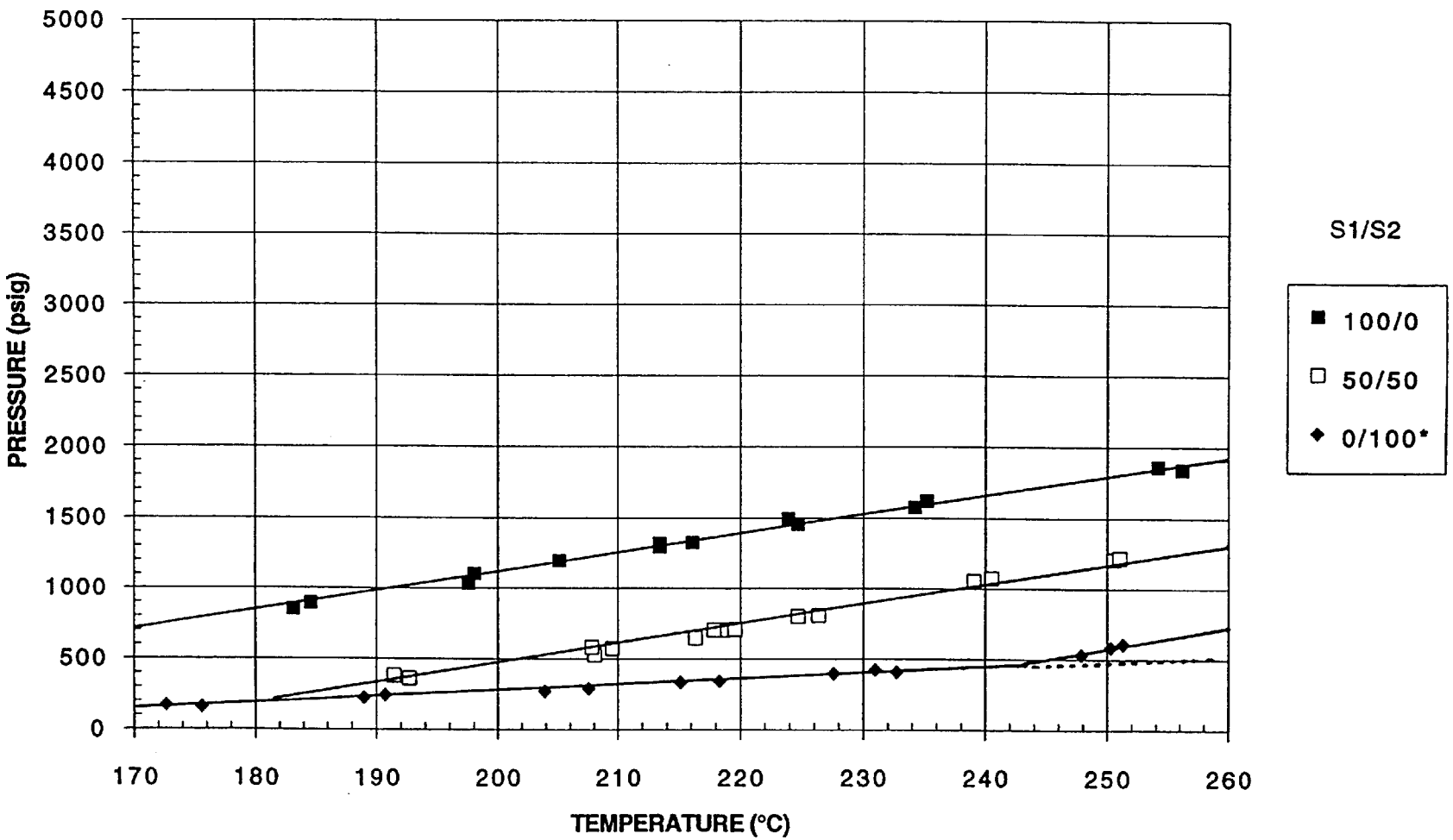
FIG. 15 is a plot of the cloud point data for a solution comprised of 20% of a copolymer of ethylene and tetrafluoroethylene in a solvent comprised of HCFC-122 and HCFC-123 at different ratios.
Figure 16:
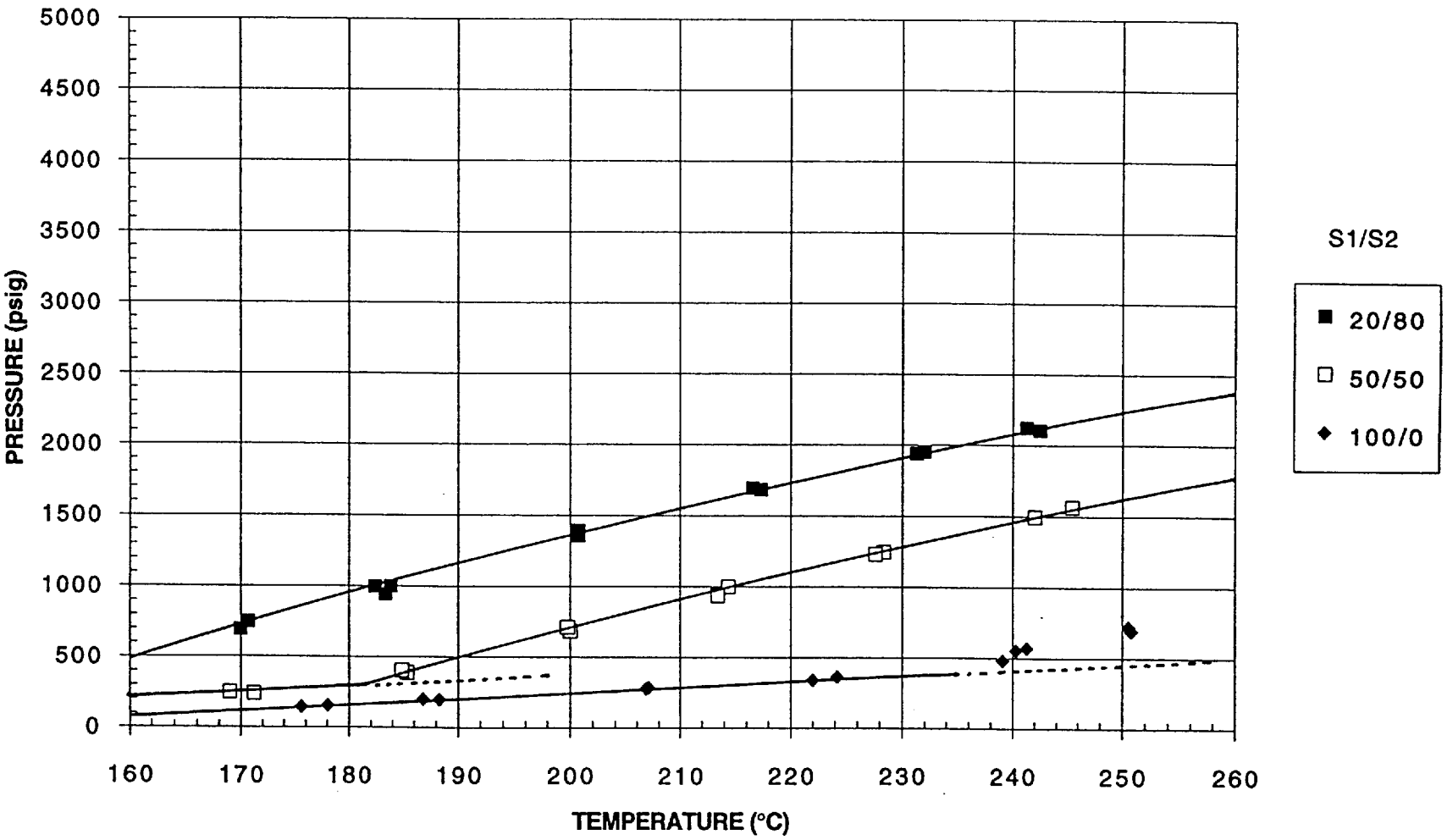
FIG. 16 is a plot of the cloud point data for a solution comprised of 20% of a copolymer of ethylene and chlorotrifluoroethylene in a solvent comprised of HCFC-122 and HCFC-123 at different ratios.

There are other compounds such as 1,1,3-trichloro-2,2,3,3-tetrafluoropropane (HCFC-224ca); 1,2-dichloro-3,3,3-trifluoropropane (HCFC-243db) and 1,2-dichloro-1-fluoroethylene (HCFC-1121) that are effective spin agents and can be used without addition of a co-spin agent. As can be seen from FIGS. 12, 13, and 14, these spin agents exhibit cloud points that are effective to make the desired plexifilamentary, film-fibril material. However, co-spin agents can be used with these spin agents to adjust (i.e., either to raise or lower) the cloud point pressure.

In order to spread the web formed when polymers are flash spun in the commercial operations, the flash spun material is projected against a rotating baffle: see, for example, Brethauer et al. U.S. Pat. No. 3,851,023, and then subjected to an electrostatic charge. The baffle causes the product to change directions and start to spread, and the electrostatic charge causes the product (web) to further spread. In order to achieve a satisfactory commercial product in a commercially acceptable time, it is necessary that the web achieve a significant degree of spread, and this can be achieved only if sufficient electrostatic charge remains on the web for the desired time. The charge will dissipate too rapidly if the atmosphere surrounding the web has too low a dielectric strength. A major component of the atmosphere surrounding the web is the vaporized spin agents that, prior to flash spinning, dissolved the polymer which was flash spun. As disclosed in U.S. Pat. No. 5,672,307, primary spin agents such as methylene chloride or 1,2-dichloroethylene, with co-spin agents as listed therein, have a dielectric strength, when vaporized, sufficient to maintain an effective electric charge on the web to insure a satisfactory product. These mixtures have a dielectric strength as measured by ASTM D-2477 of greater than about 40 kilovolts per centimeter (KV/cm). The spin agents of the subject invention, however, have a much higher dielectric strength than methylene chloride and approaches that of trichlorofluoromethane (Freon 11). Some typical values are as follows:

| Compound | Dielectric Strength (KV/cm) |
|---|---|
| Methylene Chloride | ~45 |
| Dichloroethylene | ~105 |
| HCFC-122 | ~120 |
| Freon 11 | ~120 |

Co-spin agents can be added to methylene chloride to raise the dielectric strength and the cloud point pressure. However, for dichloroethylene and HCFC-122, co-spin agents are added primarily to raise the cloud point pressure.

Because the mixture of spin agents has a boiling point that is relatively close to room temperature, a high pressure spin agent recovery system is not necessary; furthermore, a high pressure spin agent injection system is not necessary.

Further, the spin agent mixtures of the present invention are either non-flammable or of very low flammability.

There is a wide range of compounds that can be used as co-spin agents as long as they exhibit less solvent power for the particular polyolefin than does HCFC-122 and its isomers. Co-spin agents that can be used include hydrocarbons (particularly those having four carbons or less), hydrofluorocarbons(HFC's), hydrofluoroethers (HFOC's), perfluorocarbons (PFC's), hydrochlorofluorocarbons (HCFC's), polar solvents, inert gases and carbon dioxide. Some specific examples of co-spin agents are 1,1-dichloro-2,2,2-trifluoroethane (HCFC-123); 1,1-dichloro-2,2,3,3,3-pentafluoropropane (HCFC-225ca); 1,1,1,2 tetrafluoroethane(HFC-134a); 1,1,2,2,3,3,4,4-octafluorobutane (HFC-338pcc); 1,1,1,2,2,3,4,5,5,5-decafluoropentane (HFC-4310mee); perfluoropentane (3M PF 5050); perfluoro-N-methylmorpholine (3M PF5052); 1,1,2,2,3,3,3-heptafluoropropyl 1,2,2,2-tetrafluoroethyl ether (HFOC E-1); perfluorobutyl methyl ether (3M HFE-7100); and perfluorobutyl ethyl ether (3M HFE-7200). Other specific co-spin agents that are useful in this invention are inert gases such as the noble gases and nitrogen. Polar solvents such as ketones, ethers, alcohols and the like can be used as co-spin agents as long as they do not react with the primary spin agents to be used at the spin temperature to any appreciable extent and they do not make the spin fluid too flammable. The spin fluid may further contain additives such as nucleating agents, stabilizers and the like.

Microcellular foams can be obtained by flash-spinning and are usually prepared at relatively high polymer concentrations in the spinning solution i.e., at least 40 wgt. % synthetic fiber-forming polyolefin.

Polyethylene, polyproplyene, copolymers of ethylene and tetrafluoroethylene, and copolymers of ethylene and chlorotrifluoroethylene are synthetic fiber-forming polyolefins that can be used. Also, relatively low spinning temperatures and pressures that are above the cloud point pressure are used. Microcellular foam fibers may be obtained rather than plexifilaments, even at spinning pressures slightly below the cloud point pressure of the solution. Spin agents used are the same as those noted above for plexifilamentary, film-fibril materials. Similarly, the co-spin agents that typically can be used are the same as those noted above and include hydrocarbons (particularly those having four carbons or less) hydrofluorocarbons (HFC's), hydrofluoroethers (HFOC's), perfluorocarbons (PFC's), hydrochlorofluorocarbons (HCFC's), polar solvents, inert gases and carbon dioxide. Nucleating agents, such as fumed silica and kaolin, are usually added to the spin mix to facilitate spin agent flashing and to obtain uniform small size cells.

Microcellular foams can be obtained in a collapsed form or in a fully or partially inflated form. For many polymer/solvent systems, microcellular foams tend to collapse after exiting the spinning orifice as the solvent vapor condenses inside the cells and/ or diffuses out of the cells. To obtain low density inflated foams, inflating agents are usually added to the spin liquid. Suitable inflating agents that can be used include low boiling temperature partially halogenated hydrocarbons, such as, hydrochlorofluorocarbons, hydrofluorocarbons, chlorofluorocarbons, and perfluorocarbons; hydrofluoroethers; inert gases such as carbon dioxide and nitrogen; low boiling temperature hydrocarbon solvents such as butane and isopentane; and other low boiling temperature organic solvents and gases.

Microcellular foam fibers are normally spun from a round cross section spin orifice. However, an annular die similar to the ones used for blown films can be used to make microcellular foam sheets.

EXAMPLES

Test Methods

In the description above and in the non-limiting examples that follow, the following test methods were employed to determine various reported characteristics and properties. ASTM refers to the American Society of Testing Materials, and TAPPI refers to the Technical Association of the Pulp and Paper Industry.

The denier of the strand is determined from the weight of a 15 cm sample length of strand.

Tenacity, elongation and toughness of the flash-spun strand are determined with an Instron tensile-testing machine. The strands are conditioned and tested at 70° F. (21° C.) and 65% relative humidity. The strands are then twisted to 10 turns per inch and mounted in the jaws of the Instron Tester. A two-inch gauge length was used with an initial elongation rate of 4 inches per minute. The tenacity at break is recorded in grams per denier (gpd). The elongation at break is recorded as a percentage of the two-inch gauge length of the sample. Toughness is a measure of the work required to break the sample divided by the denier of the sample and is recorded in gpd. Modulus corresponds to the slope of the stress/strain curve and is expressed in units of gpd.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem. Soc., V. 60 p 309–319 (1938) and is reported as $m^2/g$.

Test Apparatus for Examples 1–22

The apparatus used in the examples 1–22 is the spinning apparatus described in U.S. Pat. No. 5,147,586. chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer.

A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with both a length and a diameter shown in the tables below. Orifice measurements are expressed in mils (1 mil=0.0254 mm). The pistons are driven by high pressure water supplied by a hydraulic system.

In the tests reported in Examples 1–22, the apparatus described above was charged with pellets of a polyolefin and a spin agent. High pressure water was used to drive the pistons to generate a mixing pressure of between 1500 and 3000 psig (10,443–20,786 kPa). The polymer and spin agent were next heated to mixing temperature and held at that temperature for about. 30 to 60 minutes during which time the pistons were used to alternately establish a differential pressure of about 50 psi (345 kPa) or higher between the two cylinders so as to repeatedly force the polymer and spin agent through the mixing channel from one cylinder to the other to provide mixing and to effect formation of a spin mixture. The spin mixture temperature was then raised to the final spin temperature, and held there for about 15 minutes to equilibrate the temperature, during which time mixing was continued. In order to simulate a pressure letdown chamber, the pressure of the spin mixture was reduced to a desired spinning pressure just prior to spinning. This was accomplished by opening a valve between the spin cell and a much larger tank of high pressure water ("the accumulator") held at the desired spinning pressure. The spinneret orifice is opened about one to three seconds after the opening of the valve between the spin cell and the accumulator. This period roughly corresponds to the residence time in the letdown chamber of a commercial spinning apparatus. The resultant flash-spun product is collected in a stainless steel open mesh screen basket. The pressure recorded just before the spinneret using a computer during spinning is entered as the spin pressure.

The experimental conditions and the results for Examples 1–22 are given below in the Tables 1–4. All the test data not originally obtained in the SI system of units has been converted to the SI units. When an item of data was not measured, it is noted in the tables as nm. Particularly in the tables that follow and elsewhere, the amount of primary spin agent and co-spin agent may be expressed by their percentage by weight of the combined weight of the primary spin agent and the co-spin agent.

Examples 1–11

In Examples 1–11, ALATHON® high density polyethylene obtained from Lyondell Petrochemical Co., Houston, Tex. was flashspun from a number of spin agents. The polyethylene was used at a concentration of 12 wgt.% with a melt index of 0.75, a number average molecular weight of 27,000 and a molecular weight distribution (MWD) of 4.43. MWD is the ratio of weight average molecular weight to number average molecular weight.

The primary spin agent used was HCFC-122, and the co-spin agents included HCFC-123, HFC-134A, HFC338pcc, HFC-4310mee, HFOC E-1 and PF 5050.

Weston 619F, a diphosphite thermal stabilizer from GE Specialty Chemicals, may be added at 0.1 wgt.% based on the total weight of the spin agent (BOS).

TABLE 1

| | SOLVENT | | | ADDITIVE | | MIXING | | | |
|---|---|---|---|---|---|---|---|---|---|
| Example | 1 | 2 | S1/S2 Wt % | Type | Wt % | Temp ° C. | Time Min | Back Psig | ΔP |
| 1 | HCFC-122 | HFOC E-1 | 90/10 | Weston 619F | 0.1 | 210 | 30 | 2500 | 150 |
| 2 | HCFC-122 | HFC-134A | 90/10 | Weston 619F | 0.1 | 210 | 30 | 2500 | 150 |
| 3 | HCFC-122 | HFC-338pcc | 85/15 | Weston 619F | 0.1 | 205 | 30 | 2200 | 200 |
| 4 | HCFC-122 | HFC-338pcc | 90/10 | Weston 619F | 0.1 | 210 | 30 | 2500 | 150 |
| 5 | HCFC-122 | HFC-43-10mee | 90/10 | Weston 619F | 0.1 | 205 | 30 | 2000 | 200 |
| 6 | HCFC-122 | HFC-43-10mee | 90/10 | Weston 619F | 0.1 | 210 | 30 | 2500 | 150 |
| 7 | HCFC-122 | PF5050 | 90/10 | Weston 619F | 0.1 | 210 | 30 | 2500 | 150 |
| 8 | HCFC-122 | HCFC-123 | 60/40 | NONE | 0 | 205 | 45 | 2900 | 200 |
| 9 | HCFC-122 | HCFC-123 | 50/50 | NONE | 0 | 205 | 45 | 2900 | 200 |
| 10 | HCFC-122 | HCFC-123 | 50/50 | Weston 619F | 0.1 | 200 | 45 | 2500 | 200 |
| 11 | HCFC-122 | HCFC-123 | 40/60 | NONE | 0 | 205 | 45 | 2900 | 200 |

| | SPINNING | | | | PROPERTIES @ 10 tpi | | | | | | BET |
|---|---|---|---|---|---|---|---|---|---|---|---|
| Example | Spinneret d × 1 mils | Accum. P psig | Spin P psig | Spin Temp ° C. | gms load | Den | Mod gpd | Ten gpd | To gpd | E % | BET SA (m2/gm) |
| 1 | 30 × 30 | 1350 | 1200 | 211 | 100 | 286 | 5.8 | 2.7 | 0.9 | 54 | nm |
| 2 | 30 × 30 | 1350 | 1200 | 210 | 100 | 219 | 8.4 | 3.5 | 1.6 | 68 | nm |
| 3 | 30 × 30 | 1400 | 1250 | 207 | 100 | 288 | 13 | 3.6 | 1.9 | 77 | nm |
| 4 | 30 × 30 | 1450 | 1325 | 210 | 40 | 278 | 4.5 | 2.2 | 0.9 | 60 | nm |
| 5 | 30 × 30 | 1000 | 800 | 205 | 100 | 306 | 10 | 3.1 | 2.3 | 112 | nm |
| 6 | 30 × 30 | 900 | 800 | 211 | 100 | 281 | 8.7 | 2.5 | 1.4 | 86 | 14 |
| 7 | 30 × 30 | 1000 | 900 | 211 | 100 | 202 | 9.9 | 4 | 1.5 | 58 | nm |

TABLE 1-continued

| | | | | | | | | | | | |
|---|---|---|---|---|---|---|---|---|---|---|---|
| 8 | 30 × 30 | 1100 | 100 | 205 | 100 | 237 | 19 | 4.7 | 3.9 | 120 | nm |
| 9 | 30 × 30 | 1450 | 1325 | 205 | 100 | 254 | 17 | 4.3 | 2.5 | 90 | 15 |
| 10 | 30 × 30 | 1650 | 1475 | 201 | 100 | 279 | 18 | 5 | 3.2 | 95 | 21 |
| 11 | 30 × 30 | 2000 | 1850 | 206 | 100 | 290 | 18 | 4.6 | 2.5 | 85 | nm |

Examples 12–18

In Examples 12–18,samples of isotactic polypropylene with relatively narrow MWD, less than 6, were obtained from Montell (previously known as Himont) of Wilmington, Del. The samples were flash-spun using HCFC-122 as the primary spin agent and the co-spin agents included HCFC-123, HFC-4310mee, HFE-7100, HFOC E-1 and PF 5052.

Weston 619F was added as noted in Examples 1–11, above.

Examples 19–20

In Examples 19–20, ALATHON® high density polyethylene obtained from Lyondell Petrochemical Co. (Houston, Tex.) was flashspun from a number of spin agents. The polyethylene was used at a concentration of 12 wgt.% with a melt index of 0.75 a number average molecular weight of 27,000 and a MWD of 4.43. The spin agents used were 1,2-dichloro-1-fluoroethylene and HCFC-243db.

TABLE 2

| POLYMER | | | SPIN AGENT | | | | ADDITIVE | MIXING | | | |
|---|---|---|---|---|---|---|---|---|---|---|---|
| Example | MFR | Conc. Wt % | 1 | 2 | S1/S2 Wt % | TYPE | Wt % BOS | Temp ° C. | Time Min | Back P psig | ΔP |
| 12 | 1.43 | 9 | HCFC-122 | HCFC-123 | 30/70 | Weston 619F | 0.1 | 220 | 30 | 2500 | 400 |
| 13 | 1.43 | 9 | HCFC-122 | HCFC-123 | 30/70 | Weston 619F | 0.1 | 220 | 30 | 2500 | 400 |
| 14 | 1.43 | 9 | HCFC-122 | HCFC-123 | 50/50 | Weston 619F | 0.1 | 220 | 30 | 3000 | 400 |
| 15 | 1.43 | 9 | HCFC-122 | HFC-4310mee | 65/35 | Weston 619F | 0.1 | 210 | 30 | 2500 | 200 |
| 16 | 2.3 | 8 | HCFC-122 | HFE-7100 | 60/40 | Weston 619F | 0.1 | 210 | 30 | 2200 | 200 |
| 17 | 2.3 | 8 | HCFC-122 | PF5052 | 65/35 | Weston 619F | 0.1 | 210 | 30 | 2200 | 200 |
| 18 | 2.3 | 8 | HCFC-122 | HFOC E-1 | 70/30 | Weston 619F | 0.1 | 210 | 30 | 2500 | 150 |

| | SPINNING | | | | POLY-MER | | PROPERTIES @ tpi | | | | | |
|---|---|---|---|---|---|---|---|---|---|---|---|---|
| Example | Spinneret d × 1 mils | Accum P psig | Spin P psig | Spin T ° C. | MFR | Conc. Wt % | gms load | Den | Mod gpd | Ten gpd | To gpd | E % |
| 12 | 30 × 30 | 1300 | 1200 | 220 | 1.43 | 9 | 40 | 192 | 5.6 | 1.8 | 1.2 | 100 |
| 13 | 30 × 30 | 1200 | 1100 | 219 | 1.43 | 9 | 40 | 240 | 4.1 | 1.5 | 0.9 | 97 |
| 14 | 30 × 30 | 900 | 875 | 221 | 1.43 | 9 | 40 | 167 | 5.3 | 1.5 | 1.3 | 124 |
| 15 | 30 × 30 | 1600 | 1475 | 210 | 1.43 | 9 | 40 | 316 | 1.8 | 0.6 | 0.4 | 102 |
| 16 | 30 × 30 | 1475 | 1400 | 210 | 2.3 | 8 | 40 | 204 | 2.3 | 0.7 | 0.6 | 121 |
| 17 | 30 × 30 | 1400 | 1325 | 210 | 2.3 | 8 | 40 | 298 | 2.1 | 0.9 | 0.6 | 99 |
| 18 | 30 × 30 | 1800 | 1675 | 210 | 2.3 | 8 | 40 | 237 | 2.1 | 0.7 | 0.6 | 125 |

TABLE 3

| | SPIN AGENT | MIXING | | | | SPINNING | | | | PROPERTIES @ 10 tpi | | | | | | BET SA |
|---|---|---|---|---|---|---|---|---|---|---|---|---|---|---|---|---|
| Ex-amples | Spin Agent | Temp °C. | Time Min | Back P psig | ΔP | Spinneret d × 1 mils | Accum P psig | Spin P psig | Spin Temp °C. | gms load | Den | Mod gpd | Ten gpd | To gpd | E % | (m2/gm) |
| 19 | 1,2-di-chloro-1-fluoro-ethylene | 215 | 45 | 2500 | 200 | 30 × 30 | 1300 | 1225 | 215 | 100 | 171 | 19 | 5.5 | 2.1 | 63 | nm |

TABLE 3-continued

| | SPIN AGENT | MIXING | | | | SPINNING | | | | PROPERTIES @ 10 tpi | | | | | | BET SA |
|---|---|---|---|---|---|---|---|---|---|---|---|---|---|---|---|---|
| Ex-amples | Spin Agent | Temp °C. | Time Min | Back P psig | ΔP | Spinneret d × 1 mils | Accum P psig | Spin P psig | Spin Temp °C. | gms load | Den | Mod gpd | Ten gpd | To gpd | E % | (m2/gm) |
| 20 | HCFC-243db | 210 | 20 | 2200 | 200 | 30 × 30 | 1450 | 1300 | 210 | 100 | 294 | 8.6 | 2.9 | 1.1 | 62 | 12 |

Example 21

A sample fluoropolymer, TEFZEL® HT2127 available from DuPont which is an ethylene/tetraflouroethylene copolymer was flashspun using a spin fluid comprising a spin agent of 20 wgt. % HCFC-122 and co-spin agent of 80 wgt % HCFC-123. The fluoropolymer was present at 20 wgt.% of the spin fluid. Polymers of this type have melting points between 235° C. and 280° C.

Example 22

A sample fluoropolymer, HALAR® 200 available from Ausimont, which is an ethylene/ chlorotrifluoroethylene copolymer was flashspun using a spin fluid comprising a spin agent of 50 wgt. % HCFC-122 and co-spin agent of 50 wgt.% HCFC-123. The fluoropolymer was present at 20 wgt.% of the spin fluid. HALAR® 200 has a melt index of 0.7 and a melting point of 240° C.

Example 24

A sample of high density polyethylene having a melt index of 0.75 was mixed in a spin fluid comprising a spin agent of 80 wgt.% HCFC-122 and 20 wgt.% HCFC-123. The polyethylene was present at 40 wgt.% of the spin fluid. Mixing was done at 1500° C. for 45 min at 1500 psig (10,443 kPa). The differential pressure was 1900 psi (13,100 kPa). Spinning took place at a 1000 psig (6996 kPa) accumulator pressure with the spinning being done at 275 psig (1997 kPa) at 151° C. Acceptable microcellular foam was obtained.

What is claimed is:

1. A process which comprises flash-spinning at a pressure that is greater than the autogenous pressure of the spin fluid into a region of lower pressure, a spin fluid comprising (a) at least 40 wgt.% synthetic fiber-forming polyolefin, and (b) a primary spin agent selected from the group consisting of 1,1,2-trichloro-2,2 difluoroethane and isomers thereof, thereby forming microcellular foam fibers of the synthetic fiber-forming polyolefin.

2. The process of claim 1, wherein the synthetic fiber-forming polyolefin is selected from the group consisting of polyethylene, polypropylene, partially fluorinated copolymers of ethylene and tetrafluoroethylene and partially fluorinated copolymers of ethylene and chlorotrifluoroethylene.

3. The process of claim 1, wherein the synthetic fiber-forming polyolefin is present at between about 40 and 60 wgt.%.

4. The process of claim 1, wherein the spin fluid comprises a spin agent having at least 40 wgt.% of 1,1,2-trichloro-2,2-difluoroethane and isomers thereof.

5. The process of claim 1, wherein the spin fluid further comprises a co-spin agent selected from the group consisting of hydrocarbons, hydrofluorocarbons, hydrofluoroethers, perfluorocarbons, hydrochlorofluorocarbons, polar solvents, inert gases and carbon dioxide.

6. The process of claim 5, wherein the co-spin agent is selected from the group consisting of 1,1-dichloro-2,2,2-trifluoroethane; 1,1-dichloro-2,2,3,3,3-pentafluoropropane; 1,1,1,2 tetrafluoroethane; 1,1,2,2,3,3,4,4-octafluorobutane;

TABLE 4

| | | | | MIXING | | | | SPINNING | | | | | | | | | |
|---|---|---|---|---|---|---|---|---|---|---|---|---|---|---|---|---|---|
| Ex- | SOLVENT | | | | | Back | | Accum | Spin | | PROPERTIES @ 10 tpi | | | | | | |
| ample No. | 1 | 2 | S1/S2 Wt % | °C. | Min | P psig | ΔP | P psig | P psig | °C. | gms load | Den | Mod gpd | Ten gpd | To gpd | E% | BET SA m2/gm |
| 21 | HCFC-122 | HCFC-123 | 20/80 | 220 | 30 | 200 | 200 | 930 | 825 | 220 | 100 | 345 | 10 | 1.9 | 0.3 | 33 | 28 |
| 22 | HCFC-122 | HCFC-123 | 50/50 | 220 | 30 | 250 | 200 | 900 | 700 | 221 | 50 | 683 | 3.9 | 1 | 0.2 | 35 | nm |

Examples 23–24

Microcellular foam was made in the following examples by mixing and spinning polyolefin at selected pressures and temperatures using a spin agent of HCFC122 and a co-spin agent of HCFC-123. In each example the spinneret hole measured 30 mil×30 mil (diameter×length). Also, in each example, additives used were 1.0 wgt. % Cab-O-Sil N70-TS (fumed silica), based on the weight of the polymer and 0.1 wgt. % of Weston 619F thermal stabilizer based on the weight of the spin agent plus the weight of the co-spin agent.

Example 23

A sample of Profax 6523 polypropylene from Montell and having a melt flow rate of 4 was mixed in a spin fluid comprising a spin agent of 50 wgt.% HCFC-122 and 50 wgt.% HCFC-123. The polypropylene was present at 50 wgt.% of the spin fluid. Mixing was done at 150 C for 45 min at 1500 psig (10,443 kPa). The differential pressure was 1000 psi (6996 kPa). Spinning took place at a 840 psig (5892 kPa) accumulator pressure with the spinning being done at 350 psig (2515 kPa) at 151 C.

Acceptable microcellular foam was obtained.

1,1,1,2,2,3,4,5,5,5-decafluoropentane; perfluoro-N-methylmorpholine; 1,1,2,2,3,3,3-heptafluoropropyl 1,2,2,2-tetrafluoroethyl ether; perfluorobutyl methyl ether; perfluorobutyl ethyl ether; and nitrogen.

7. The process of claim 1, wherein the spin fluid comprises nucleating agents selected from the group consisting of fumed silica and kaolin.

8. The process of claim 1, wherein the spin fluid comprises low boiling inflating agents selected from the group consisting of hydrochlorofluorocarbons, hydrofluorocarbons, hydrofluoroethers, chlorofluorocarbons, perfluorocarbons, butane, isopentane, carbon dioxide and nitrogen.

* * * * *